US006682147B1

(12) United States Patent
Leoutsakos

(10) Patent No.: US 6,682,147 B1
(45) Date of Patent: Jan. 27, 2004

(54) ADJUSTABLE SUPPORT

(76) Inventor: Thomas Leoutsakos, P.O. Box 253, Medford, MA (US) 02155

( * ) Notice: Subject to any disclaimer, the term of this patent is extended or adjusted under 35 U.S.C. 154(b) by 0 days.

(21) Appl. No.: 10/228,386

(22) Filed: Aug. 27, 2002

(51) Int. Cl.[7] ..... A47C 16/02

(52) U.S. Cl. ..... 297/423.41; 297/423.46; 297/423.45; 297/423.43; 297/423.44; 248/346.06; 248/371; 248/423

(58) Field of Search ..... 297/423.46, 423.44, 297/423.43, 423.41, 423.39, 423.45; 248/346.06, 371, 423

(56) References Cited

U.S. PATENT DOCUMENTS

| | | | | | |
|---|---|---|---|---|---|
| 2,248,369 | A | * | 7/1941 | Ludersen | 297/423.45 X |
| 2,528,331 | A | * | 10/1950 | Bell | 297/423.46 |
| 2,938,573 | A | * | 5/1960 | Stanley | 297/423.46 |
| 3,132,835 | A | * | 5/1964 | Drabert | 297/423.45 X |
| 3,653,715 | A | * | 4/1972 | Drabert et al. | 297/423.45 |
| 4,549,767 | A | * | 10/1985 | Hampshire et al. | 297/423.46 |
| 4,873,966 | A | * | 10/1989 | Gitter | 297/423.46 |
| 5,294,180 | A | * | 3/1994 | Grimm | 297/423.45 X |
| 5,348,377 | A | * | 9/1994 | Grosch | 297/423.45 |
| 5,356,203 | A | * | 10/1994 | Levasseur et al. | 297/423.45 |
| 5,419,618 | A | * | 5/1995 | Hatcher | 297/423.45 X |
| 5,577,806 | A | * | 11/1996 | Ugalde | 297/423.46 |
| 5,584,535 | A | * | 12/1996 | Jacobson et al. | 297/423.45 X |
| 5,626,393 | A | * | 5/1997 | Levasseur et al. | 297/423.45 X |
| 5,683,331 | A | * | 11/1997 | Dalebout | 297/423.45 X |
| 5,765,921 | A | * | 6/1998 | Chuang | 297/423.45 X |
| 6,454,357 | B1 | * | 9/2002 | Konovalov et al. | 297/423.41 |

FOREIGN PATENT DOCUMENTS

| | | | | |
|---|---|---|---|---|
| DE | 3728717 A1 | * | 3/1989 | 297/423.46 |
| DE | 4304531 A1 | * | 8/1994 | 297/423.46 |

* cited by examiner

*Primary Examiner*—Rodney B. White
(74) *Attorney, Agent, or Firm*—G. Kersey

(57) ABSTRACT

Method and apparatus providing a rest member having a support surface and a stand for the rest member, with the rest member having a plural multiplicity of apertures therein to permit the adjustment in height thereof with respect to the stand, which can take the form of an expandable member associated with the rest member and being contractable as well as expandable inwardly and outwardly

17 Claims, 3 Drawing Sheets

ADJUSTABLE SUPPORT

BACKGROUND OF THE INVENTION

1. Field of the Invention

This invention relates to an adjustable support and, more particularly, to a foot rest support which can be adjusted in both height and width.

2. Description of the Need for the Invention

Many persons, particularly elderly and disabled persons, often desire to have an accessory, such as a foot rest, which can be used in a variety of ways. In one usage, a person might wish to elevate the foot or both feet in order to alleviate a physical condition, such as pain that is occasioned by having the foot occupy a restrained position for a prolonged period of time. In other usages, the foot rest can provide a suitable support when the person is seated or is in a position where such support is desired.

Various solutions have been proposed which typically are complex and costly.

Accordingly, it is a principal object of the invention to provide a support that is inexpensive and simple to construct and can meet the requirements of persons who wish to support body appendages such as legs in order to satisfy a physical or exercise requirement.

SUMMARY OF THE INVENTION

In accomplishing the foregoing and related objects, the invention provides a rest member having a support surface, and a stand for the rest member which has a plural multiplicity of apertures in the support surface for receiving the stand to permit the adjustment in height of the support surface with respect to the stand.

In accordance with one aspect of the invention, the stand is an expandable and contractable member associated with the rest member. The expansion and contraction of the stand can take place inwardly and outwardly.

In accordance with another aspect of the invention, an object to be supported can be positioned on the rest member which is slidably adjustable for one setting of the rest member with respect to the stand and is slidably adjustable at a different elevation of the rest member for another setting of tile rest member with respect to the stand.

In accordance with a further aspect of the invention, the stand is formed by a plurality of tubular members which are movable relative to one another. Each tubular member has a leg extending to an upwardly disposed connector that forms an acute angle with respect to the leg. The upwardly disposed connector extends to a downwardly disposed connector attached to another leg. A rod is inserted into aligned legs permits relative movement between the connected legs.

In accordance with still another aspect of the invention, the rest member includes multiple pairs of elongated apertures of different lengths into which the stand is inserted.

In accordance with the method of the invention for supporting an object, the steps include (a) providing a rest member having a support surface; (b) forming a plurality of apertures of different lengths in the support surface; and (c) positioning the rest member on a stand therefor with respect to the apertures; thereby to permit the adjustment in height of the rest member with respect to the stand.

The method further includes the step of expanding or contracting the stand associated with the rest member, with the contraction possible after expansion or vice versa.

The method also includes the step of expanding the stand inwardly and outwardly and the step of positioning an object on the rest member.

In accordance with another aspect of the invention, the method includes the step of forming the stand by a plurality of tubular members which are movable relative to one another. Each tubular member can have a leg extending to an upwardly disposed connector that forms an acute angle with respect to the leg. The upward connector can be extended to a downwardly disposed connector attached to a leg.

The method also includes the step of inserting a rod into a leg of the stand to permit connection to another leg, and relative movement between the connected legs. The rest member can be provided with a plurality of elongated apertures of different lengths into which the stand is insertable.

DESCRIPTION OF THE DRAWINGS

Other aspects of the invention will become apparent after considering several illustrative embodiments taken in conjunction with the drawings in which.

DETAILED DESCRIPTION

Figure 1:
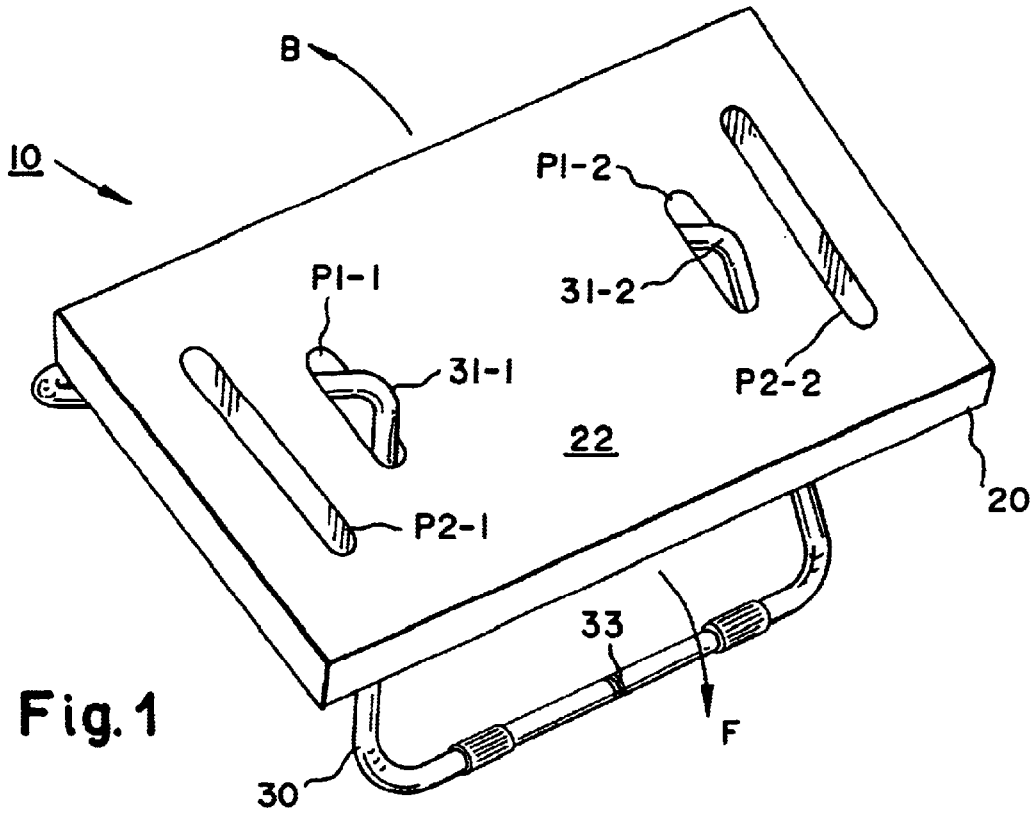
FIG. 1 is a perspective view of an adjustable support in accordance with the invention that its forward and backward movement of its support surface.

As shown in the perspective view of FIG. 1, an adjustable support 10 in accordance with the invention is formed by a support member 20 having a support surface 22 and a plurality of pairs P1 and P2 of elongated apertures in the support surface 22. In the embodiment of FIG. 1 there are two pairs of apertures P1 and P2, with the first pair P1 formed by elongated apertures P1-1 and P1-2 and the second, shorter pair P2 formed by elongated apertures P2-1 and P2-2. The longer pair P2 accompanies the shorter pair P1 in order to permit adjustment in height of the support surface 22 with respect to a stand 30. The support member 20 is positioned at its aperture positions over apex portions 31-1 and 31-2 of the stand 30.

As illustrated in FIG. 1, the support member 20 has its apertures P2-1 and P2-2 on the apex members 31-1 and 31-2 so that the support surface is in its lower position. When the stand 30 is adjusted so that the apex members 31-1 and 31-2 respectively occupy the apertures P1-1 and P1-2, the support surface is in an elevated position.

Whether the stand occupies the first pair of apertures P1 or the second pair of apertures P2, the support 10 permits forward movement as indicated by the arrow F, and backward movement as indicated by the arrow B of the support surface 22.

Figure 2:
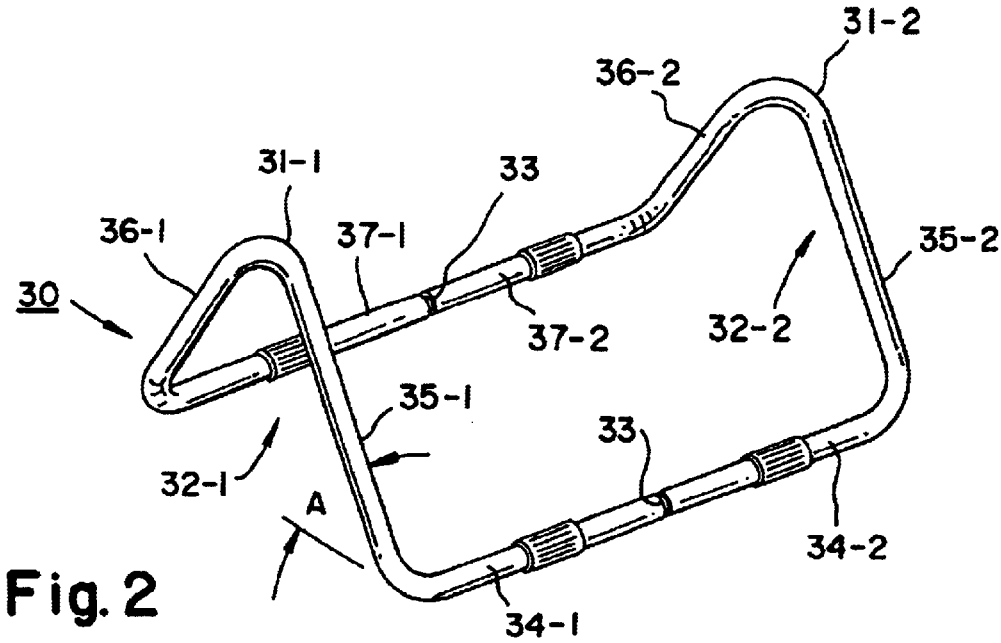
FIG. 2 is a perspective view of the support for the embodiment of FIG. 1.

As shown in FIG. 2, which is a perspective view of the support 10 for the embodiment of FIG. 1, the stand 30 is formed by a pair of tubular members 32-1 and 32-2. The members 32-1 and 32-2 are adjustable inwardly and outwardly by virtue of rods 33 which are inserted between adjoining legs of the tubular members 32-1 and 32-2. Each tubular member 32-1 or 32-2 has a leg 34-1 or 34-2 extending to an upwardly disposed connector 35-1 that forms an acute angle A with respect to the leg 34-1 or 34-2. The upward connector 35-1 or 35-2 can be extended to a downwardly disposed connector 36-1 or 36-2 attached to a leg 37-1 or 37-2.

Insertion of the rod 33 into a leg 34-1 of the stand 30 permits connection to an opposite leg 34-2, and relative movement between the connected legs 34-1 and 34-2. Similarly, insertion of the rod 33 into a leg 37-1 permits connection to an opposite leg 37-2. Because of the adjustability of the stand 30, the support member 20 is provided, as discussed above with a plurality of elongated apertures P1 and P2 of different lengths into which the stand 30 is insertable. As in the case of FIG. 1, the support surface 22 can be moved forwardly in the direction of the arrow F or backwardly in the direction of the arrow B.

Figure 3:
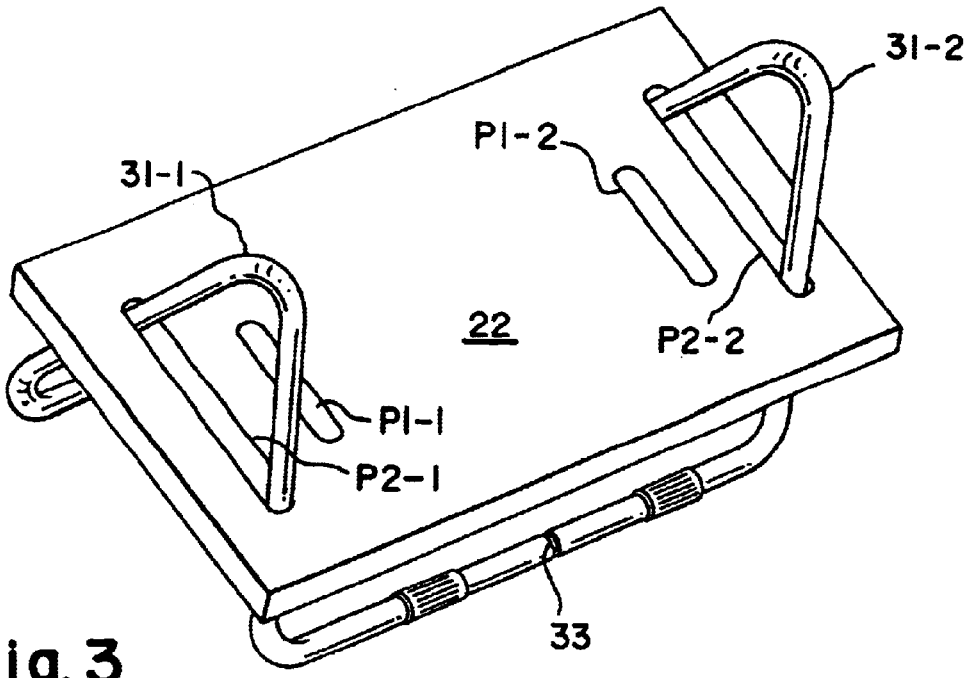
FIG. 3 is a perspective view of the support of FIG. 1 for which the support surface has been lowered by being moved to the outermost support position of the stand.

As shown in FIG. 3, which is a perspective view of the support of FIG. 1, the support surface 22 has been lowered by being moved to the outermost support position provided by the apertures P2 of the stand 30. By contrast, with FIG. 3, FIG. 4 is a perspective view of the support of FIG. 3, which has been positioned for possible side-to-side movement indicated by the arrows S of an object placed on the support surface 22.

Figure 4:
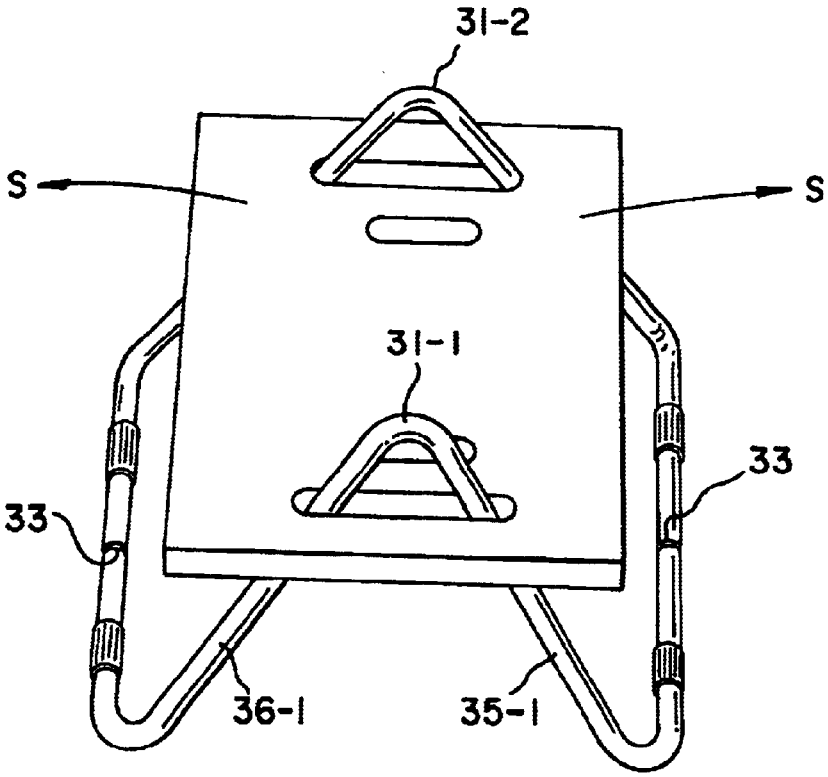
FIG. 4 is a perspective view of the support of FIG. 3 which has been positioned for possible side-to-side movement of an object placed on the support surface.
Figure 5:
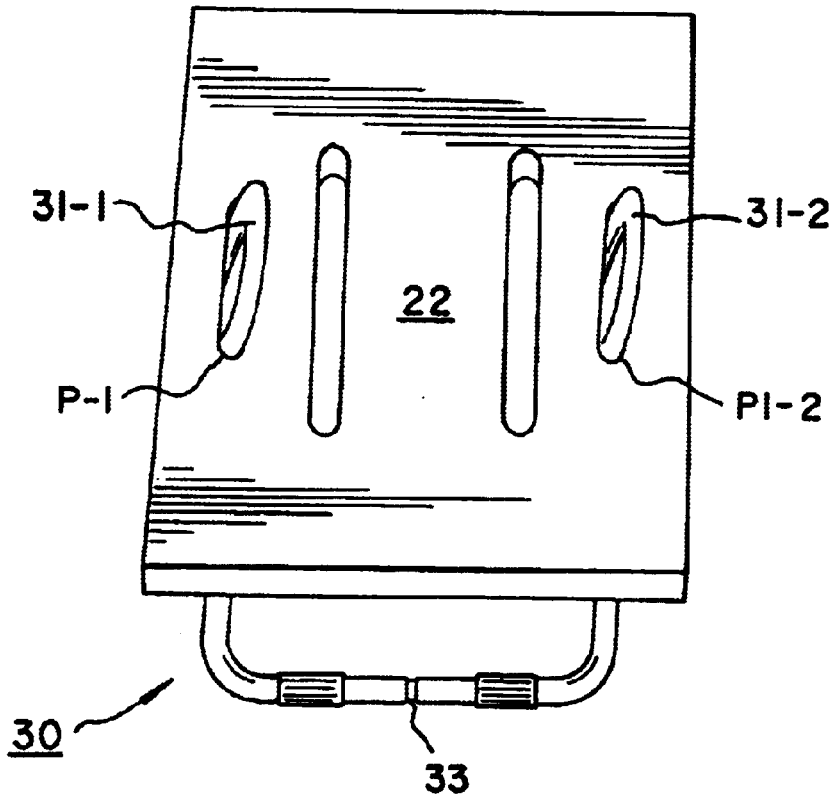
FIG. 5 is a perspective view of an alternate embodiment in which the elongated support surface of FIG. 4 has been positioned for possible forward and backward movement.
Figure 6:
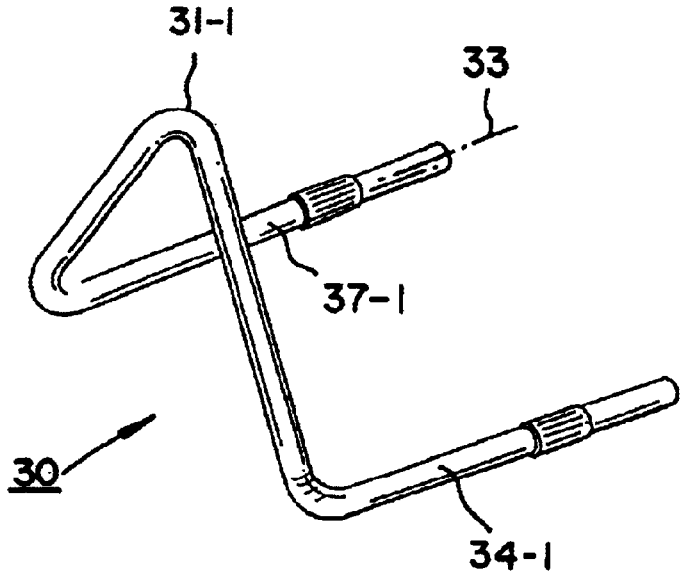
FIG. 6 is a perspective view showing separation of the tubular members forming the stand and indicating the rod that is used to permit adjustment of the tubular members relative to one another.

In the alternative embodiment of FIG. 5, the elongated support surface 22 of FIG. 4 has been positioned for possible forward and backward movement, again indicated by the arrows F and B by the use of an elongated pair of apertures P3-1 and P3-2. In addition, a further set of shorter apertures P4-1 and P4-2 are positioned near the respective elongated edges 35-1 and 35-2 to permit forward and backward movement of the support surface 22 in the position of maximum elevation for the support 10.

To clarify the relationship of the rods 33 to the stand members 32-1 and 32-2, the portion 32-1 is shown separated from the portion 32-2, with one rod 33 removed and the other rod 33 retained in only one leg.

It will be understood that the foregoing detailed description is illustrative only and that modifications may be made without the departing from the spirit and scope of the invention as defined in the appended claims.

What is claimed:

1. Apparatus comprising: a rest member having a support surface, and a stand for said rest member, said rest member having apertures therein to permit the adjustment in height thereof with respect to stand, wherein said stand is an expandable and contractable member associated with said rest member, wherein said expandable member associated with said rest member, is expandable inwardly and outwardly.

2. Apparatus as defined in claim 1 wherein an object to be supported is positioned on said rest member.

3. Apparatus as defined in claim 1 wherein said stand is formed by a plurality of tubular members which are movable relative to one another.

4. Apparatus comprising: a rest member having a support surface, and a stand for said rest member, said rest member having apertures therein to permit the adjustment in height thereof with respect to said stand, wherein said stand is formed by a plurality of tubular members which are movable relative to one another and wherein each tubular member has a leg extending to an upwardly disposed connector forming an acute angle with respect to said leg.

5. Apparatus as defined in claim 4 wherein said upwardly disposed connector extends to a downwardly disposed connector connected to a leg.

6. Apparatus as defined an claim 4 wherein a rod is inserted into said leg to permit connection to another leg and relative movement between the connected legs.

7. Apparatus comprising: a rest member having a support surface, and a stand for said rest member, said rest member having apertures therein to permit the adjustment in height thereof with respect to said stand, wherein said rest member includes a plurality of elongated apertures of different lengths into which said stand is inserted.

8. The method of supporting an object comprising the steps of:

(a) providing a rest member having a support surface;

(b) forming a plurality of apertures of different lengths in said support surface, and (c) positioning said rest member on a stand therefor with respect to said apertures; thereby to permit the adjustment in height of said rest member with respect to said stand.

9. The method as defined in claim 8 further including the step of expanding said stand associated with said rest member.

10. The method as defined in claim 9 further including the step of contracting said stand after the expansion thereof.

11. The method as defined in claim 10 further including the step of expanding said stand inwardly and outwardly.

12. The method as defined in claim 8 further including the step of positioning an object on said rest member.

13. The method as defined in claim 8 further including the step of forming said stand by a plurality of tubular members which are movable relative to one another.

14. The method as defined in claim 13 further including the step of forming each tubular member with a leg extending to an upwardly disposed connector forming an acute angle with respect to said leg.

15. The method as defined in claim 14 further including the step of extending said upwardly disposed connector to a downwardly disposed connector connected to a leg.

16. The method as defined in claim 8 further including the step of inserting a rod into said leg to permit connection to another leg and relative movement between the connected legs.

17. The method as defined in claim 8 further including the step of providing said rest member with a plurality of elongated apertures of different lengths into which said stand is inserted.

* * * * *